US006786024B2

(12) United States Patent
Sichera et al.

(10) Patent No.: US 6,786,024 B2
(45) Date of Patent: Sep. 7, 2004

(54) METHOD AND APPARATUS FOR INSERTING A COVER SHEET BETWEEN A TRANSPARENT FILM AND A BOOK-LIKE CASE

(75) Inventors: Massimiliano Sichera, Renazzo di Cento (IT); Gianni Sichera, Pieve di Cento (IT)

(73) Assignee: Sichera Di Sichera Gianni, Bologna (IT)

( * ) Notice: Subject to any disclaimer, the term of this patent is extended or adjusted under 35 U.S.C. 154(b) by 0 days.

(21) Appl. No.: 10/416,660

(22) PCT Filed: Nov. 13, 2001

(86) PCT No.: PCT/IB01/02132

§ 371 (c)(1),
(2), (4) Date: May 14, 2003

(87) PCT Pub. No.: WO02/40350

PCT Pub. Date: May 23, 2002

(65) Prior Publication Data

US 2004/0025477 A1 Feb. 12, 2004

(30) Foreign Application Priority Data

Nov. 14, 2000 (IT) ..... BO2000A0653

(51) Int. Cl.[7] ..... B65B 61/20

(52) U.S. Cl. ..... 53/445; 53/458; 53/474; 53/156; 53/155; 53/238

(58) Field of Search ..... 53/445, 458, 474, 53/156, 157, 155, 564, 238, 250, 429, 117

(56) References Cited

U.S. PATENT DOCUMENTS

| | | | | |
|---|---|---|---|---|
| 3,884,013 A | * | 5/1975 | Solomon | 53/467 |
| 4,912,910 A | * | 4/1990 | Lowe et al. | 53/429 |
| 5,479,760 A | * | 1/1996 | Petrell | 53/445 |
| 5,551,217 A | | 9/1996 | Huening et al. | |
| 6,233,909 B1 | * | 5/2001 | Onishi | 53/473 |
| 6,324,816 B1 | * | 12/2001 | Yamamoto | 53/429 |
| 6,374,574 B1 | * | 4/2002 | Onishi | 53/238 |

FOREIGN PATENT DOCUMENTS

| | | |
|---|---|---|
| EP | 0 894 725 | 2/1999 |
| GB | 2 246 549 | 2/1992 |
| WO | WO 99 44889 | 9/1999 |
| WO | WO 00 53503 | 9/2000 |
| WO | WO 00 63078 | 10/2000 |

* cited by examiner

*Primary Examiner*—Eugene Kim
*Assistant Examiner*—Sameh H. Tawfik
(74) *Attorney, Agent, or Firm*—William J. Sapore; Coleman Sudol Sapone, P.C.

(57) ABSTRACT

A method for introducing a cover sheet (2) between a transparent sheet (3) and a book-like container (4), which is substantially formed by a pair of closure members (4*a*, 4*b*), externally wrapped within the film (3), includes:

opening the container (4) by opening said closure members (4*a*, 4*b*) by an angle wider than 180°;

detaching the transparent film (3) from the outer surface of said closure members (4*a*, 4*b*);

making a transversal corrugation in a cover sheet (2) situated beside said opened container (4), near an area (2) delimited by said opened members (4*a*, 4*b*) and the detached film (3);

introduction of gripping means (10), situated on a side opposite with respect to said corrugated cover sheet (2), into said area (Z);

gripping said corrugated cover sheet (2) and pulling it, by said gripping means (10), into said area (Z);

releasing said cover sheet (2) into said area (Z), which cover sheet consequently spread across said area Z;

defining a flattened configuration of the closure members (4*a*, 4*b*) so that said cover sheet (2) spreads over a plane.

16 Claims, 4 Drawing Sheets

FIG. 3
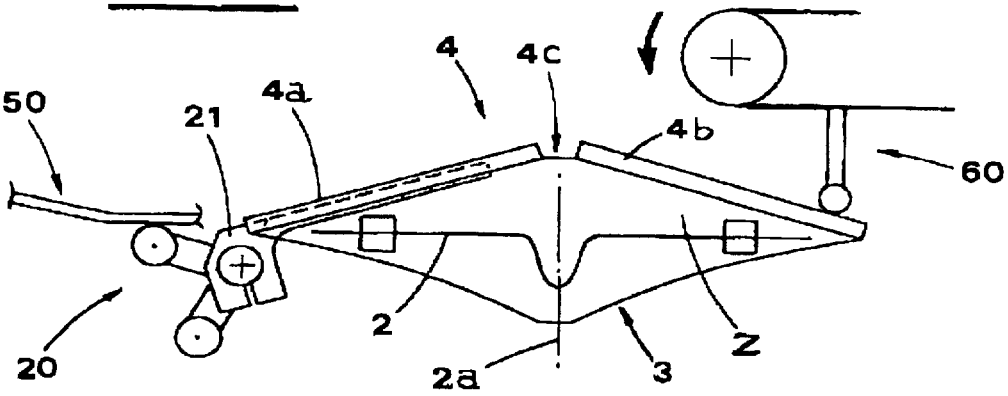
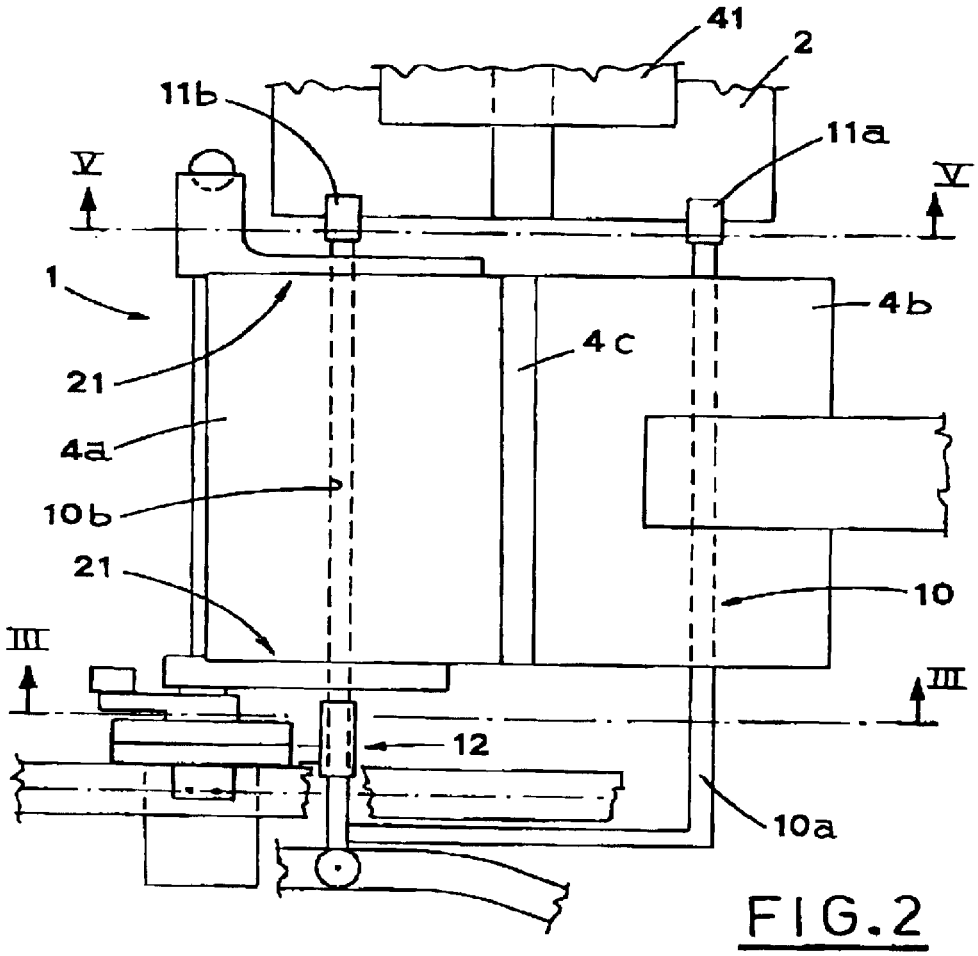
FIG. 2

METHOD AND APPARATUS FOR INSERTING A COVER SHEET BETWEEN A TRANSPARENT FILM AND A BOOK-LIKE CASE

TECHNICAL FIELD OF THE INVENTION

The present invention relates to the technical field concerned with machines for packaging articles, e.g. opto-magnetic supports, like compact discs, CD ROM, DVD, etc. into relative book-like containers.

More precisely, the invention relates to a method for introducing a cover sheet between a transparent film and a book-like container, wrapped within the film, and to a device which carries out the method.

DESCRIPTION OF PRIOR ART

As far as CDs and DVDs packaging, those skilled in the art currently know containers made of plastic material and formed by a pair of planar closure members, substantially book-like hinged to each other along a common edge and equipped with suitable closing means, e.g. snap means situated on the side opposite to the joining edge.

The closure members are designed in a way to form a base closure member, including suitable means fixed to its inner surface for receiving the articles (a CD and/or a DVD) and possibly informative leaflets, and an upper closure member designed to close the container with the cooperation of the above mentioned closing means.

The closure members are wrapped externally by a transparent protective film, fastened to the closure members along the edges opposite to the hinge side.

Usually, a cover sheet carrying information about the article packaged in the container, is introduced between the transparent film and the outer surface of the container.

These packages are currently processed by known automatic machines which take closed containers one by one from a suitable magazine, open them and introduce CDs or DVDs therein together with an accompanying informative leaflet, also taken one by one from respective magazines.

Introducing a cover sheet between the transparent film and the container is a particularly difficult and complicated operation step of the packaging process, because of the close contact between the film and the container.

A serious problem which often occurs during the introduction of the cover sheet derives from the fact that the containers are fed, after being opened, with their inner part turned upwards, so as to introduce therein the articles (CDs or DVDs) and informative leaflets.

British document GB-A-2.246.549 describes a method for opening containers for video cassettes (VHS) and for introducing an informative leaflet in the area defined between the outer walls of the container and a transparent film wrapping the container, and the corresponding apparatus which carries out the method.

In particular, the above mentioned apparatus, working on open containers in flat configuration and turned upwards, includes means for moving downwards the transparent film, away from the outer walls of the container, thus opening the walls forming the container by an angle wide more than 180°.

Suitable working means introduce the informative leaflet, folded and/or undulated, into the area defined between the inclined walls of the container and the transparent film.

The introducing means grip the informative leaflet, push it into the area between the opened members and the transparent film detached therefrom, and then release it, after the introduction has been completed.

Afterwards, the closure members of the container are rotated until they reach again the flat configuration, thus making the informative leaflet to stretch coplanar and substantially touching the outer surfaces of the container.

One of the disadvantages of the above apparatus derives from the fact that the cover sheet can be placed incorrectly, which has a negative effect on the container aesthetic look and can reduce the acceptance of the final client.

In any case, a very serious problem is always present, which problems derives from possible stumbling of the cover sheet while being inserted into the area between the outer surfaces of the opened members of the container and the transparent film, as the sheet is pushed into the above area by relative means.

SUMMARY OF THE INVENTION

The object of the present invention is to propose a method for introducing a cover sheet between a transparent film and book-like openable container, which avoids the above mentioned disadvantages and allows to introduce the cover sheet correctly and automatically, in a simple and easy way, while ensuring a faultless positioning of the same cover sheet.

Another object of the present invention is to propose a devices which carries out the proposed method and can easily be adapted to different sizes of the containers, so as not to hinder the introduction of the cover sheet.

A further object of the present invention is to propose a method and a related device, which introduce the cover sheet into a continuously moving container.

A still further object of the present invention is to propose a device obtained by a simple technical solution which ensures high reliability and production rate in any operation condition, and which ensures rapid and best introduction of the cover sheet between the transparent film and the container.

The above mentioned objects are obtained according to the invention, by the proposed method for introducing a cover sheet between a transparent protective film and a book-like container wrapped within the film, said container 4 being substantially formed by a couple of closure members 4*a*, 4*b*, which are hinged one to the other along a corresponding edge 4*c* and which are wrapped within said protective film 3, fastened to said closure members 4*a*, 4*b* along the edges opposite to the hinge edge 4*c*, said method being characterized in that it includes:

- opening the container 4 by opening said closure members 4*a*, 4*b* by an angle wider than 180° with respect to the closing configuration of the closure members 4*a*, 4*b;*
- detaching said transparent film 3 from the outer surface of said closure members 4*a*, 4*b;*
- making a transversal corrugation in a cover sheet 2, situated beside said opened container 4, near an area Z defined by said opened closure members 4*a*, 4*b* and said detached film 3;
- introducing of gripping means 10, situated on the side opposite with respect to the corrugated cover sheet 2, into said area Z;
- gripping the above mentioned corrugated cover sheet 2 and pulling it, by said gripping means 10, into said area Z;
- releasing of the above cover sheet 2 inside said area Z, which cover sheet consequently spread across said area Z;

defining a flattened configuration of the closure members 4*a*, 4*b* so that said cover sheet 2 spreads over a plane.

The proposed method is carried out in accordance with the above mentioned objects and according to the invention, by a device for introducing a cover sheet between a transparent protective film and a book-like container wrapped externally within the film, with said container 4 being substantially formed by a couple of closure members 4*a*, 4*b*, which are hinged to each other along a corresponding edge 4*c* and which are externally wrapped with said protective film 3, fastened to said closure members 4*a*, 4*b* along the edges opposite to the hinge edge 4*c*, said device characterized in that it includes: means 20 for opening the container 4, moved by first conveying means 31, which opening means support and open said closure members 4*a*, 4*b* by an angle wider than 180° with respect to the close configuration of said members 4*a*, 4*b*; first means for detaching said transparent film 3 from the outer surface of said open container 4; second means 40, operated in time relation with said first means, for corrugating crosswise a cover sheet 2 situated beside said open container 4, near an area Z delimited by said closure members 4*a*, 4*b* and said detached film 3; gripping means 10, situated on the side opposite to said corrugated cover sheet 2 and moved by second conveying means 32 for entering said area Z and removably gripping said cover sheet 2 and pull it completely into said area Z.

BRIEF DESCRIPTION OF THE DRAWINGS

The characteristic features of the invention are pointed out in the following, with particular reference to the enclosed drawings, in which:

FIG. 2 is a schematic, enlarged plan view of the particular K indicated in FIG. 1;

FIG. 3 is a schematic view taken along III—III of FIG. 2;

DESCRIPTION OF PREFERRED EMBODIMENTS

Figure 1:
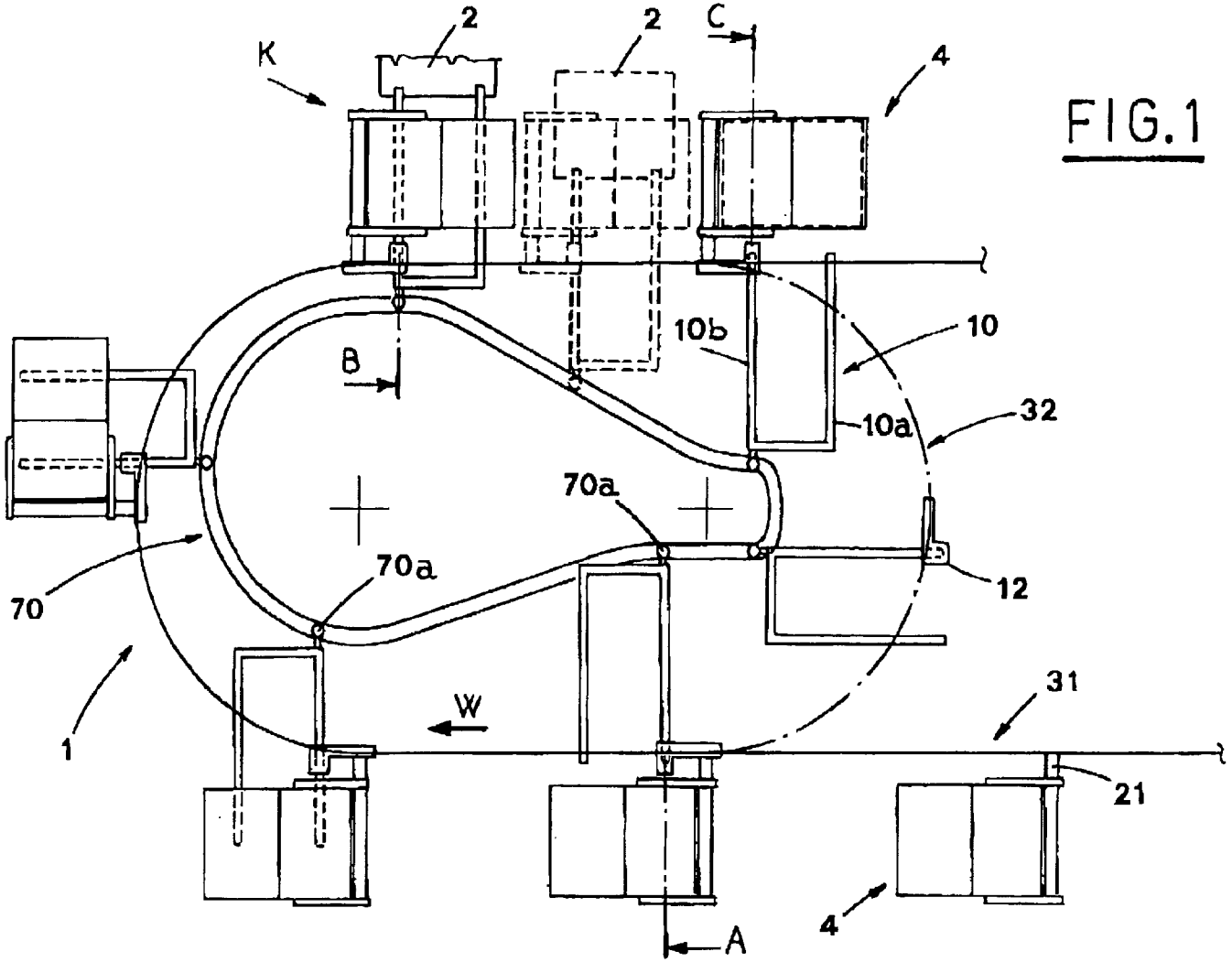
FIG. 1 is a schematic plan view of the proposed inserting device.

With reference to the above described Figures, reference numeral 1 indicates the proposed device for inserting a cover sheet 2 between a transparent film 3 and a related container 4 for articles, e.g. CD-ROM, DVD-ROM supports and the like.

According to known techniques, the container 4 is formed by a pair of box-like closure members 4*a*, 4*b*, hinged one to the other along a corresponding edge 4*c*.

The closure members 4*a*, 4*b* are wrapped within a protective transparent film 3, fastened to the edges opposite to the hinge edge 4*c*.

According to the proposed method for introducing a cover sheet 2 between the transparent film 3 and the closure members 4*a*, 4*b* of the container 4, a closed container 4 is taken from a suitable magazine, and then it is opened until the opening angle between the closure members 4*a*, 4*b* is wider than 180° with respect to the close configuration.

After the opening step, the transparent film 3 is moved away from the outer surface of the closure members 4*a*, 4*b*, e.g. by suction cups connected to a vacuum source, so as to define an area Z between the outer surface of the closure members 4*a*, 4*b* and the transparent film 3 detached therefrom.

The cover sheet 2 to be introduced between the protective film 3 and the container 4, is fed in spread configuration, aligned with the opened container 4 and beside it.

Before being fed, the container 4 is corrugated transversely along a median area 2*a*, so as to reduce its longitudinal dimensions during introduction.

Gripping means 10, situated on the side opposite with respect to the corrugated cover sheet 2, enter the area Z included between the transparent film 3 and the outer surface of the closure members 4*a*, 4*b*, grip the corrugated cover sheet 2, and pull it inside the area Z, with the transparent film 3 being kept detached from the closure members 4*a*, 4*b*.

After the corrugated cover sheet 2 has been inserted, the gripping means 10 release it within the area Z included between the transparent film 3, also released from the detached configuration, and the outer surface of the opened closure members 4*a*, 4*b*, thus allowing the corrugated cover sheet 2 to spread according to a configuration tending to be planar.

The container 4, equipped with the suitably positioned cover sheet 2, is brought back to the flattened configuration characterized by an opening angle, substantially equal to 180°.

According to an advantageous aspect of the proposed method, the container 4 and the relative gripping means 10 are moved continuously.

More precisely, the gripping means 10, while inserting into the area Z defined by the opened closure members 4*a*, 4*b* and the detached film 3, to grip the cover sheet 2, and while pulling the corrugated cover sheet 2 into the area Z, are steady with respect to the movement direction of the container 4.

This means that the gripping means 10 are moved in the same movement direction of the container 4 with the same speed as the latter, thus avoiding relative shifts of the gripping means 10 and the container 4, which consequently remain one beside the other.

According to the working cycle of the packaging machines, the article (CD, DVD or the like) and/or the relative informative leaflet, are inserted into the container 4 before or after introduction of the cover sheet 2 into the area Z included between the transparent film 3 and the closure members 4*a*, 4*b*.

The described method can be applied either with containers 4 opened upwards or downwards, i.e. with the transparent film 3 situated, when detached, respectively under or over the container; in different cases only the opening configuration changes and in any case, the opening angle must be wider than 180°.

A possible device 1, which can carry out the above described method, includes means 20 for opening the container 4, which open the closure members 4*a*, 4*b* by an angle wider than 180° with respect to the overlapping condition.

According to the shown example, the opening means 20, working in a suitable opening area (not shown), include pliers 21, moved continuously by first conveying means 31 and supporting one of the two closure members 4*a*, 4*b*, and stabilizing means 60, which keep stopped the other closure member 4*a*, 4*b* during the container 4 opening step, i.e. the closure member which is not gripped by the pliers 21 (FIG. 3).

According to a preferred, particularly functional and reliable, embodiment, the pliers 21 are operated by cams 50 during the opening of the closure members 4*a*, 4*b* by an angle wider than 180°; having regards to this problem, see the Patent Application of the same Applicant.

Moreover, the device 1 includes first means of known type, e.g. formed by suction cups, which detach the transparent film 3 from the outer surface of the opened container 4.

Figure 4:
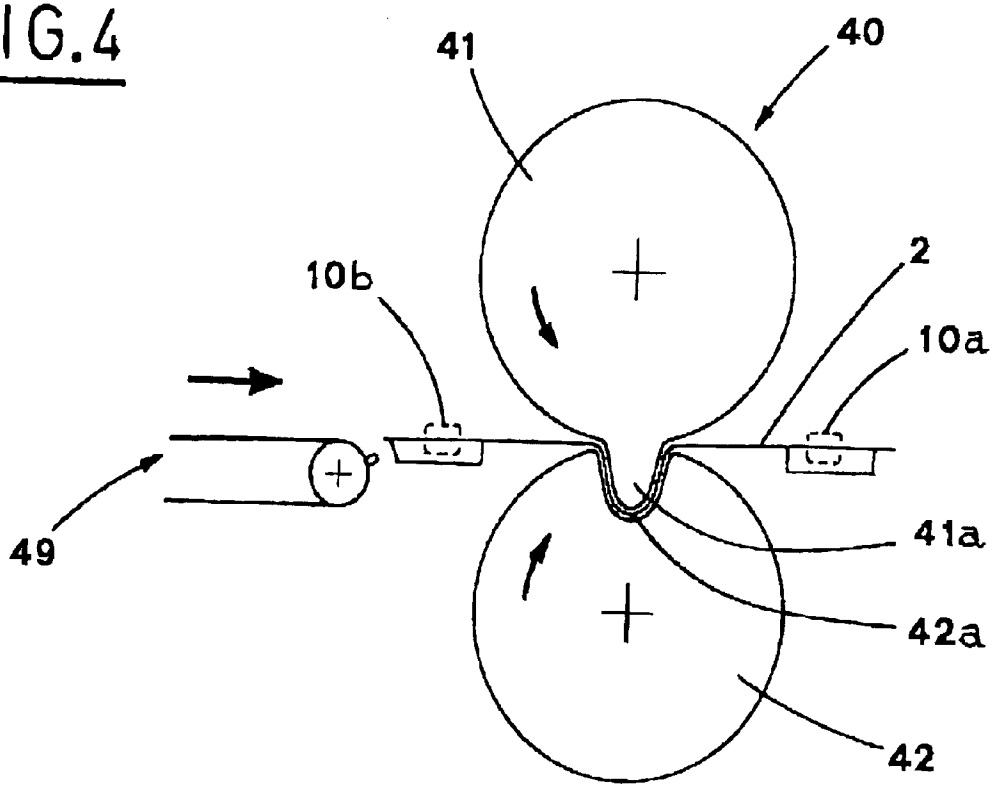
FIG. 4 is a schematic section view taken along V—V of FIG. 2.

Second means 40 work in the working station shown in FIG. 4 to make a crosswise corrugation in the cover sheet 2 near the median area 2*a*.

The second means 40, operated in time relation with the first means for detaching the film 3, include substantially two counter-rotating rollers, first 41 and second 42, whose axes lie on a common vertical plane and touch each other at the periphery, along a common generatrix.

The first roller 41, situated above the second roller 42, includes a protrusion 41*a*, extending axially and entering, in suitable time relation, a corresponding recess 42*a*, having a complementary profile, made in the second roller 42.

The cover sheet 2, which is conveyed by suitable means 49 into the area between the two rollers 41, 42, is corrugated in its median area 2*a* by the combined action which it undergoes because of the introduction of the protrusion 41*a* into the related recess 42*a* (FIG. 4).

Suitable gripping means 10, substantially fork-like, are situated on the side opposite to the corrugated cover sheet 2, to enter the area Z, to removably grip the corrugated cover sheet 2 and then to pull the latter into the area Z.

With reference to what above, the forks 10, while inserting into the area Z, are steady with respect to the pliers 21, in the forward direction of the container 4 (FIG. 1).

The forks 10, operated by second conveying means 32, preferably in continuous fashion, include a pair of prongs 10*a*, 10*b*, which introduce the area Z delimited by the opened members 4*a*, 4*b* and the film 3

Moreover, the prongs 10*a*, 10*b* are equipped with corresponding grasping elements 11*a*, 11*b*, e.g. mechanical clamps or suction cups, which grasp the corrugated cover sheet 2 and pull it into the area Z (FIG. 3).

Sleeves 12 are fastened to the second conveying means 32 in correspondence to the prongs 10*a*, 10*b* and are aimed at guiding at least one of the latter.

A first cam 70, suitably shaped, drives the prongs 10*a*, 10*b* crosswise to the second conveying means 32 during the introduction and/or leaving the area Z.

The first cam 70 includes substantially a close "U"-like track, along which a plurality of rollers 70*a* slide near the sides thereof.

The rollers 70*a* are idle and each of them is fastened to a corresponding fork 10 (FIG. 1).

The operation of the device 1 is easily understood from the above description, with reference to the working steps of the method, which it carries out.

FIG. 1 shows a plan view of a first embodiment of the proposed device, in which the conveying means, first 31 and second 32, are horizontal and situated partially one over the other and parallel to each other.

In this case, the operation of the pliers 21 and gripping means 10, driven by the relative conveying means, first 31 and second 32, must be coordinated.

The prongs 10*a*, 10*b*, one of which is guided by a relative sleeve 12, are moved longitudinally by the second conveying means 32 and slide crosswise due to the action of the first cam 70 on the rollers 70*a*, to which the forks 10 are fastened.

At the approaching section A, the prongs 10*a*, 10*b* get close to the pliers 21, which carry the closure members 4*a*, 4*b* opened by an angle wider than 180° (FIG. 1). At his section A, the distance between the roller 70*a*, fastened to the fork 10, and the corresponding pliers 21 is maximum, and consequently the relative prongs 10*a*, 10*b* remain outside the area Z, although they face it.

Beyond the approaching area A, with respect to the forward movement direction W, the distance between the roller 70*a* and the corresponding pliers 21 decreases and consequently, the prongs 10*a*, 10*b* enter gradually the area Z.

In correspondence to a gripping section B, the prongs 10*a*, 10*b* are completely within the area Z and the relative grasping elements 11*a*, 11*b* grasp the cover sheet 2, situated on the opposite side Obviously, in this case, the distance between the roller 70*a* and the corresponding pliers 21 is minimum.

Beyond the gripping section B, still with respect to the forward movement direction W, the distance between the roller 70*a* and the corresponding pliers 21 begins to increase and the prongs 10*a*, 10*b* gradually leave the area Z, pulling thereinside the cover sheet 2 previously grasped.

In correspondence to the release section C, the prongs 10*a*, 10*b* leave completely the area Z and the grasping elements 11*a*, 11*b* release the cover sheet 2 inside the area Z.

Obviously, in this case, the distance between the roller 70*a* and the corresponding pliers 21 is again maximum, like in the approaching section A.

Figure 5:
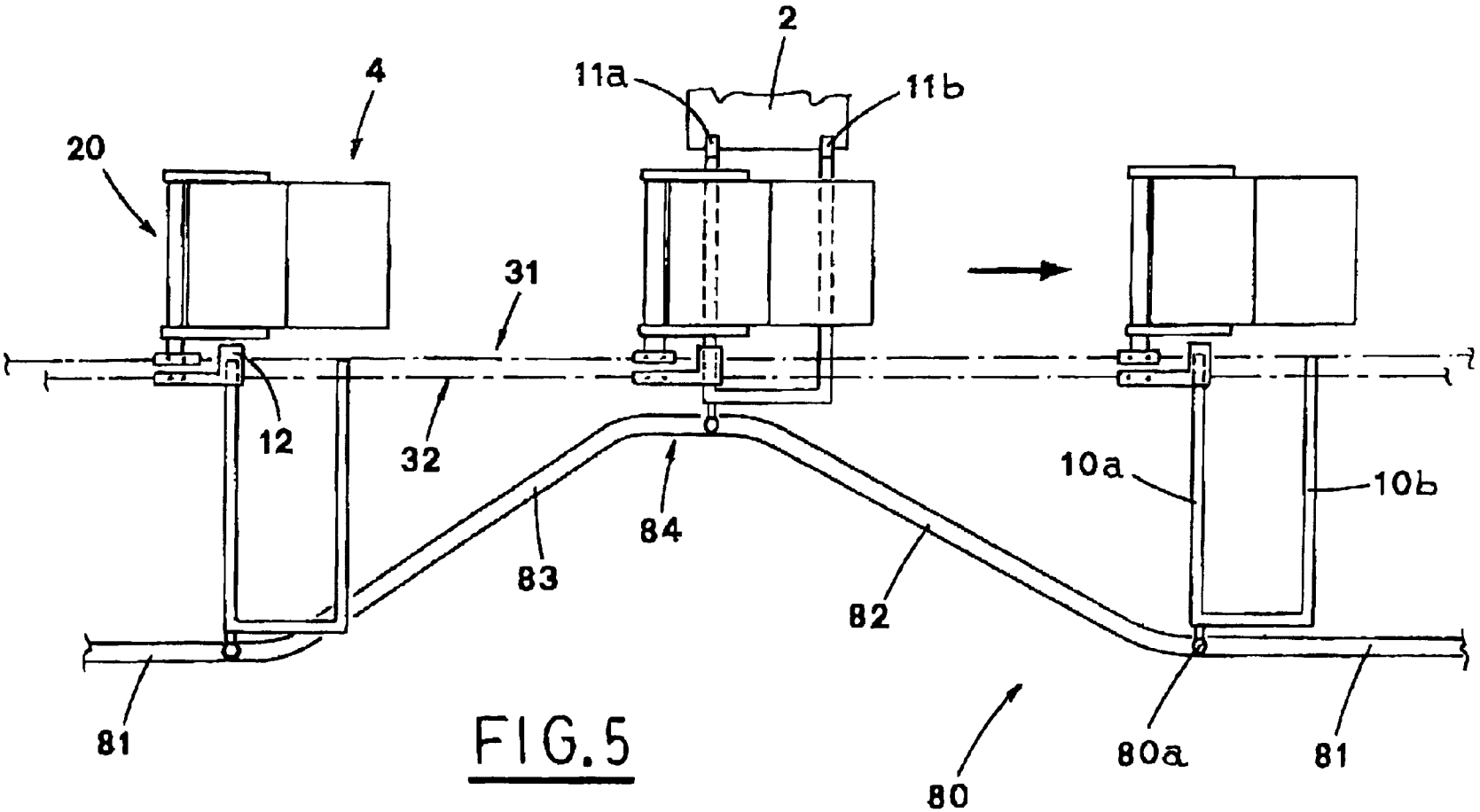
FIG. 5 is a schematic plan view of the proposed device according to another embodiment.

FIG. 5 shows a plan view of the proposed device according to another embodiment, in which the conveying means, first 31 and second 32, are situated one beside the other and lie in vertical planes, parallel to each other.

In this case, a relative motion in the forward movement direction of the containers 4, between the pliers 21 and the gripping means 10 can be avoided by operation of second cam means 80 in a simpler and more reliable way. The second cam means 80 basically include a close "U"-like path, situated coplanar with a common plane defined by the upper runs of the conveying means, first 31 and second 32.

A plurality of idle rollers 80*a* slide along the sides of the second cam means 80. Each of the rollers 80*a* is fastened to a corresponding fork 10, so as to drive the corresponding prongs 10*a*, 10*b* crosswise to the conveying means, first 21 and second 32.

The second cam means 80 include first straight sections 81, in correspondence to which the prongs 1*a*, 10*b* remain outside the area Z delimited by the opened members 4*a*, 4*b* and the film 3

The straight sections 81 alternate with oblique sections, first 82 and second 83, inclined in opposite directions, in correspondence to which the prongs 10*a*, 10*b* respectively enter and leave, the area Z.

The oblique sections, first 82 and second 83, are joined by second straight sections 84, in correspondence to which the prongs 10*a*, 10*b* are completely introduced into the area Z delimited by the opened closure members 4*a*, 4*b* and the film 3, and leave it on the opposite part to grasp, by the grasping elements 11*a*, 11*b*, the cover sheets 2.

Therefore, the proposed method and the device 1 carrying it out, fulfill the object of automatic and easy introduction of a cover sheet 2 between the transparent film 3 and the container 4, wrapped externally by the film, thus avoiding any defects of the cover sheet 2 positioning.

This is obtained especially by opening the closure members 4*a*, 4*b* of the container by an angle wider than 180° and by subsequently detaching of the film 3, which together define a wide area Z for introduction of the cover sheet 2.

The corrugating of the median area 2*a* of the cover sheet 2 allows to reduce the longitudinal dimensions thereof, so as to facilitate its introduction into the area between the opened members 4*a*, 4*b* and the film 3, detached therefrom.

In these conditions, the introduction of the cover sheet 2 is particularly simple and easy due to the fact that the cover sheet 2 is pulled by the grasping elements 11*a*, 11*b* of the related prongs 10*a*, 10*b*, which pass through the area Z defined between the opened members 4*a*, 4*b* and the film 3, from the side opposite to the covers sheet 2.

The prongs 10*a*, 10*b* formed by the forks 10 enter gradually the above mentioned area Z until the corresponding elements 11*a*, 11*b* leave the area Z on the opposite side to grasp the cover sheet 2 and pull it into the area Z, thus avoiding any jamming of the cover sheet 2.

The device which carries out the proposed method, can be easily adapted to different sizes of container 4 as well as of the corresponding cover sheet 2, e.g. by using forks 10 and/or pliers 21 of variable dimensions, thus avoiding any obstacle to the introduction of the cover sheet 2.

The proposed method and the described device can be easily applied to packaging machines operated stepwise as well as continuously.

It is understood that what above, has been described as a pure, not limitative example, therefore, possible variants of the invention remain within the protective scope of the present technical solution, as described above and claimed hereinafter.

What is claimed is:

1. A method for inserting a cover sheet between a transparent protective film and a book-like container, externally wrapped within the same film, said container being substantially formed by a pair of closure members (4*a*, 4*b*) hinged to each other along a corresponding hinge edge (4*c*) and externally wrapped within said protective film (3), said protective film being fastened to said closure members (4*a*, 4*b*) on edges opposite to the hinge edge (4*c*), including:

opening the container (4) by opening said closure members (4*a*, 4*b*) by an angle wider than 180° with respect to a close configuration of the closure members (4*a*, 4*b*);

detaching the transparent film (3) from the outer surface of said closure members (4*a*, 4*b*);

making a transversal corrugation in a cover sheet (2) situated beside said opened container (4), near an area (Z) delimited by said opened closure members (4*a*, 4*b*) and the detached film (3);

introducing said corrugated cover sheet (2), into said area (Z);

defining a flattened configuration of the closure members (4*a*, 4*b*) so that said cover sheet (2) spreads over a plane;

the method being characterized in that the step in which the cover sheet is introduced into said area (Z) is preformed by introducing gripping means (10), situated on a side opposite with respect to said corrugated cover sheet (2), into said area (Z) and gripping said corrugated cover sheet (2), followed by pulling the cover sheet, by said gripping means (10), into said area (Z), where said cover sheet (2) is released and consequently spread across said area (Z).

2. A method, according to claim 1, characterized in that said container (4) and said gripping means (10) are moved in a continuous fashion, the above mentioned operative steps including introduction of said gripping means (10) into the area delimited by said opened closure members (4*a*, 4*b*) and said detached film (3), and gripping of said corrugated cover sheet (2) and consequent pulling thereof into said area delimited by said opened closure members (4*a*, 4*b*) and said film (3) detached therefrom, being carried out without any motions with respect to the forward movement direction of said container (4).

3. A method, according to claim 1 or 2, characterized in that said container (4) in open configuration is oriented with the outer surface of said closure members (4*a*, 4*b*), wrapped within said transparent film (3), turned upwards.

4. A method, according to claim 1 or 2, characterized in that said container (4) in open configuration is oriented with the outer surface of said closure members (4*a*, 4*b*), wrapped within said transparent film (3), turned downwards.

5. A device for inserting a cover sheet between a transparent protective film and a book-like container, externally wrapped within the same film, said container (4) being substantially formed by a pair of closure members (4*a*, 4*b*) hinged to each other along a corresponding hinge edge (4*c*) and externally wrapped within said protective film (3), which film is fastened to said closure members (4*a*, 4*b*) on edges opposite to the hinge edge (4*c*), the device including:

means (20) for opening said container (4), moved by first conveying means (31), which opening means support and open said closure members (4*a*, 4*b*) by an angle wider than 180° with respect to a close configuration of said closure members (4*a*, 4*b*);

first means for detaching said transparent film (3) from an outer surface of said open container (4); second means (40), operated in time relation with said first means, for making a crosswise corrugation in a cover sheet (2) situated beside said open container (4), near an area (Z) delimited by said closure members (4*a*, 4*b*) and said detached film (3);

gripping means (10) for gripping said cover sheet and moving it into said area (Z);

the device being characterized in that:

said gripping means (10) are situated on the side opposite to said corrugated cover sheet (2) and moved by second conveying means (32) to enter said area (Z), to removably grip said cover sheet (2) and pull it completely into said area (Z).

6. A device, according to claim 5, characterized in that, while being introduced into said area (Z) delimited by said opened closure members (4*a*, 4*b*) and said detached film (3), said gripping means (10) have substantially no motion relative to said opening means (20), with respect to the forward movement direction of said container (4).

7. A device, according to claim 5, characterized in that said means (20) for opening the container (4) include pliers (21), which pliers support at least one of the above closure members (4*a*, 4*b*), and stabilizing means (60) for keeping stopped the other closure member of said closure members (4*a*, 4*b*) during opening of the container (4).

8. A device, according to claim 7, characterized in that said pliers (21) are operated by first cam means (50) during the opening of said closure members (4*a*, 4*b*).

9. A device, according to claim 5, characterized in that said gripping means (10) include fork means, which form at least one pair of prongs (10*a*, 10*b*) lying beside a plane, substantially aligned with said container (4), said prongs being aimed at entering said the area (Z) delimited by said opened closure members (4*a*, 4*b*) and said detached film (3), and being equipped with corresponding grasping elements (11*a*, 11*b*) for grasping removably said cover sheet (2) and pulling it completely into said area (Z).

10. A device, according to claim 9, characterized in that while being introduced into said the area (Z) delimited by said opened closure members (4*a*, 4*b*) and said detached film (3), said prongs (10*a*, 10*b*) are operated by cams (70, 80), designed to receive rollers (70*a*, 80*a*), each roller of said rollers being carried by a corresponding fork (10) forming said pair of prongs (10*a*, 10*b*).

11. A device, according to claim 9, characterized in that said grasping elements (11*a*, 11*b*) include suction cups connected to a vacuum source.

12. A device, according to claim 9, characterized in that it includes a sleeve (12) situated in correspondence to each fork (10) and fastened to said second conveying means (32) and guiding at least one prong (10*a*, 10*b*) of said related fork (10).

13. A device, according to claim 5, characterized in that said conveying means, first (31) and second (32), operating respectively pliers (21) and said gripping means (10), are moved in a continuous fashion.

14. A device, according to claim 5 or 13, characterized in that said conveying means, first (31) and second (32), are situated partially one over the other and parallel to each other.

15. A device, according to claim 5 or 13, characterized in that said conveying means, first (31) and second (32), are situated one beside the other, on vertical parallel planes.

16. A device, according to claim 5, characterized in that said second means (40) for making a crosswise corrugation in said cover sheet (2), include at least two counter-rotating rollers, first (41) and second (42), whose axes lie on a common vertical plane and whose edges touch along a common generatrix, said first roller (41) being situated above said second roller (42) and featuring a protrusion (41*a*), which extends axially and enters, in suitable time relation, a corresponding recess (42*a*), having a complementary profile, made in said second roller (42).

* * * * *